US006733106B1

(12) United States Patent
Leemhuis

(10) Patent No.: US 6,733,106 B1
(45) Date of Patent: May 11, 2004

(54) INK JET MAINTENANCE STATION WITH RADIAL ORIENTATION

(75) Inventor: Michael Craig Leemhuis, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 30 days.

(21) Appl. No.: 10/279,335

(22) Filed: Oct. 24, 2002

(51) Int. Cl.[7] ..... B41J 2/165

(52) U.S. Cl. ..... 347/22; 345/29; 345/30; 345/32; 345/33

(58) Field of Search ..... 347/22, 29, 30, 347/32, 33, 35

(56) References Cited

U.S. PATENT DOCUMENTS

| | | | |
|---|---|---|---|
| 5,051,761 A | 9/1991 | Fisher et al. | |
| 5,081,472 A | 1/1992 | Fisher | |
| 5,097,276 A | 3/1992 | Midorikawa | |
| 5,146,243 A | 9/1992 | English et al. | |
| 5,155,497 A | 10/1992 | Martin et al. | |
| 5,216,449 A | 6/1993 | English | |
| 5,517,218 A | 5/1996 | Lehna et al. | |
| 5,517,220 A | 5/1996 | English | |
| 5,614,930 A | 3/1997 | Osborne et al. | |
| 5,617,124 A | 4/1997 | Taylor et al. | |
| 5,635,965 A | 6/1997 | Purwins et al. | |
| 5,712,668 A | 1/1998 | Osborne et al. | |
| 5,714,991 A | 2/1998 | Osborne et al. | |
| 5,757,398 A | 5/1998 | Anderson | |
| 5,867,187 A | 2/1999 | Toniolo | |
| 5,871,292 A | 2/1999 | Johnson et al. | |
| 5,896,145 A | 4/1999 | Osborne et al. | |
| 5,936,647 A | 8/1999 | Rhodes et al. | |
| 5,963,228 A | 10/1999 | Purwins | |
| 6,082,848 A | 7/2000 | Taylor et al. | |
| 6,149,262 A | 11/2000 | Shiida et al. | |
| 6,217,145 B1 * | 4/2001 | Ito et al. | 347/28 |
| 6,663,215 B2 * | 12/2003 | Klausbruckner et al. | 347/22 |

FOREIGN PATENT DOCUMENTS

| | | |
|---|---|---|
| JP | 359190859 A | 10/1984 |
| JP | 362191155 A | 8/1987 |
| JP | 406191060 A | 7/1994 |

* cited by examiner

*Primary Examiner*—Shih-Wen Hsieh
(74) *Attorney, Agent, or Firm*—Taylor & Aust, P.C.

(57) ABSTRACT

An ink jet maintenance station for an ink jet printer with radially arranged printheads around a print drum. The maintenance station is located axially outward of the print drum, and includes a cylinder with caps and wipers at the cylinder periphery. A cam system operates upon rotation of the cylinders to elevate the caps into sealing relationship with the printhead nozzle plates. The nozzle plates are wiped by rotation of the cylinder to sweep the wipers across the nozzle plates. During non-service periods, the maintenance station does not interfere with printer carriage movement.

36 Claims, 5 Drawing Sheets

INK JET MAINTENANCE STATION WITH RADIAL ORIENTATION

BACKGROUND OF THE INVENTION

1. Field of the Invention

The present invention relates to ink jet printer maintenance stations, and, more particularly, to maintenance stations for color ink jet printers having printheads arranged radially around a print drum.

2. Description of the Related Art

Ink jet printers are used widely due to their low cost of operation, low energy use and quiet operation. Ink jet printing involves ejection of tiny ink droplets through small nozzles in a controlled manner to create the desired image. Ink is supplied from an ink reservoir to a printing head, which includes various passageways from the reservoir to the nozzle orifices. Energy is applied to the ink from an ink droplet generator near each orifice, which may include the application of electrostatic attraction, the application of oscillating forces from piezo elements, the application of heat from heating elements or the like.

During the printing process, stray droplets and pools of ink can accumulate around the nozzles on the plate surface, and the accumulations thereof can interfere with the trajectory of subsequently ejected ink droplets, thereby affecting print quality. Paper dust, fibers and debris can also accumulate on the nozzle plate, with much the same detrimental effect. To maintain proper and acceptable performance from an ink jet printhead, periodically it is necessary to perform maintenance or cleaning functions on the printhead. It is known to provide a maintenance station at which such maintenance or cleaning functions are performed.

During periods of inactivity, ink forming a meniscus in the nozzles is exposed to air, and can dry or harden, plugging the nozzle. To minimize and delay such "soft plugging" in the nozzles, the printhead is capped, to maintain an appropriate humid environment around the nozzles. However, the cap must appropriately seal to the printhead to maintain the humid environment for an extended period of time. If the cap does not seal properly to the printhead, the sealed humid environment around the nozzles is lost, and ink drying in the nozzles can occur more quickly.

For inkjet printers having one or more printheads mounted more or less in line on a carriage that moves back an forth across the media being printed, to eject ink droplets on the media, arrangement and operation of an appropriate maintenance station is known. However, it also is possible to use a printing drum, with printheads mounted radially around the drum, to eject ink droplets directly on the drum for transfer to the desired media, or to direct ink directly on the media held on the drum. Since the printheads are arranged radially around the drum, the maintenance station must also have a radial orientation to effectively operate upon the printhead nozzle plates. When not in use, the maintenance station must not interfere with carriage movement.

What is needed in the art is a simple maintenance station that provides capping and wiping operations for radially mounted ink jet printheads.

SUMMARY OF THE INVENTION

The present invention provides a radially arranged maintenance station for wiping and capping radially arranged printheads.

The invention comprises, in one form thereof, an ink jet printer with a printer frame; a print drum supported by the frame; and a plurality of printheads arranged radially of the drum. A printhead maintenance station is disposed at an end of the print drum. The station includes a rotatable maintenance cylinder having a periphery, a plurality of caps located at the periphery of the maintenance cylinder; and means for rotating the cylinder and moving the caps radially in the maintenance cylinder between a radially inward position and a radially outward position. A carriage means moves the plurality of the printheads along the print drum and over the maintenance cylinder.

The invention comprises, in another form thereof, a maintenance station for an ink jet printer. A camming spool has first and second camming spool end plates. A core spool has first and second core spool end plates. A capping slide has a carrier, a nozzle plate cap carried on the carrier and mounting means suspending the carrier between the first and second core spool end plates and between the first and second camming spool end plates. The camming spool defines a camming spool guide path for the mounting means between a radially inner position and a radially outer position. The core spool defines a core spool guide path for the mounting means between a radially inner position and a radially outer position. A drive system rotates the core spool and the camming spool both jointly with and independently of each other.

The invention comprises, in a further form thereof, a method for servicing a plurality of printheads arranged radially of a print drum. The method steps include providing a maintenance station at an end of the drum, the maintenance station including a rotatable cylinder and a plurality of radially arranged retractable caps, one of the caps for each of the printheads; moving the printheads axially outward of the drum and in alignment with the maintenance station; rotating the cylinder, and elevating the caps into sealing relationship with the printheads.

An advantage of the present invention is providing a maintenance station for printheads arranged radially around a printing drum in an ink jet printer.

Another advantage is providing a maintenance station for radially arranged printheads that does not interfere with movement of the printheads during non-maintenance operations, and that is easy to align properly with the printheads.

Yet another advantage is providing a maintenance station having nozzle plate caps that can be elevated and retracted.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
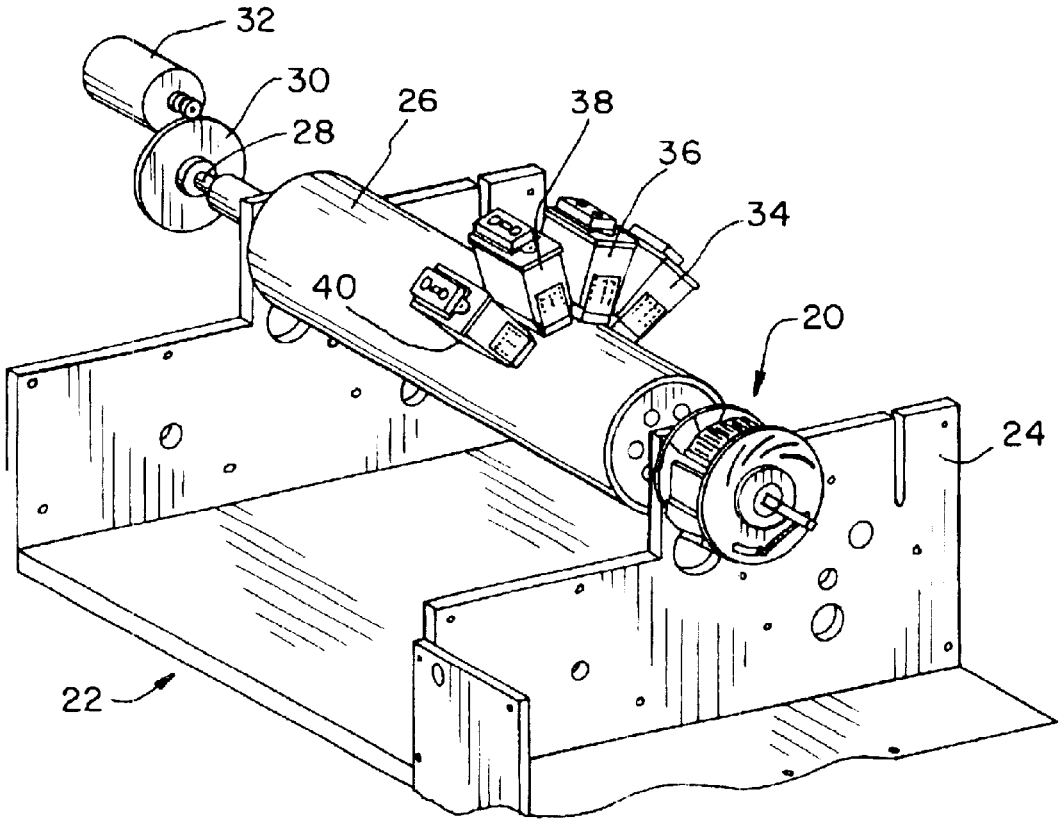
FIG. 1 is a perspective view of an ink jet printer having a maintenance station with radial orientation in accordance with the present invention.
Figure 2:
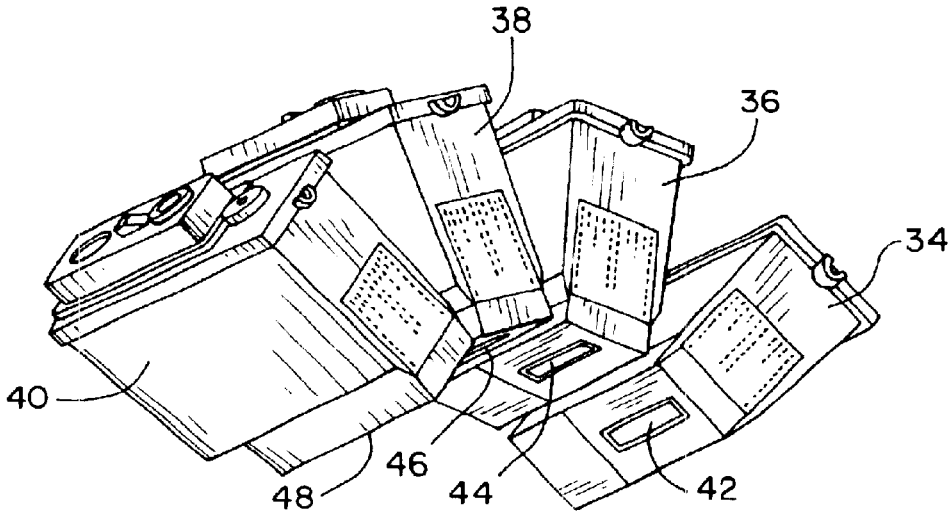
FIG. 2 is perspective view of the printheads shown in FIG. 1.

Referring now to the drawings, and particularly to FIG. 1, there is shown a radially oriented maintenance station 20 according to the present invention. Maintenance station 20 is provided in an ink jet printer 22 having a frame 24 supporting a print drum 26 on a shaft 28. A gear 30 is provided on shaft 28 and is drivingly engaged by a drive motor 32. As depicted in FIG. 1, printer 22 is a color printer having four separate printheads 34, 36, 38 and 40, one each for the four ink colors cyan, magenta, yellow and black. Each printhead 34, 36, 38 and 40 includes a nozzle plate, three such nozzle plates 42, 44 and 46 being shown in FIG. 2 for printheads 34, 36 and 38, respectively. Printhead 40 includes a similar nozzle plate (not shown), at end 48.

As known to those skilled in the art, printheads 34, 36, 38 and 40 are arranged radially outward of drum 26, and are positioned to eject ink towards print drum 26. Printheads 34, 36, 38 and 40 are carried on a carriage schematically illustrated in FIG. 8 by dashed line 50, and are caused to traverse axially along print drum 26. Ink is jetted toward print drum 26, and may be received directly on the surface of print drum 26 for subsequent transfer to print media, or the ink may be received on media carried by print drum 26. The manner in which the printing function is performed by printer 22 is well known to those skilled in the art, is not necessary to an understanding of the present invention, and will not be described in greater detail herein.

It is necessary from time to time to perform maintenance functions on the nozzle plates 42, 44 and 46 of printheads 34, 36, and 38, and a nozzle plate (not shown) for printhead 40. The maintenance functions performed include wiping to remove accumulated paper dust, ink and the like, and capping functions to prevent individual nozzles in printheads 34, 36, 38 and 40 from drying and becoming clogged. Maintenance station 20 is provided at an end of print drum 26, axially outward from print drum 26, for performing the necessary maintenance functions on printheads 34, 36, 38 and 40.

Figure 3:
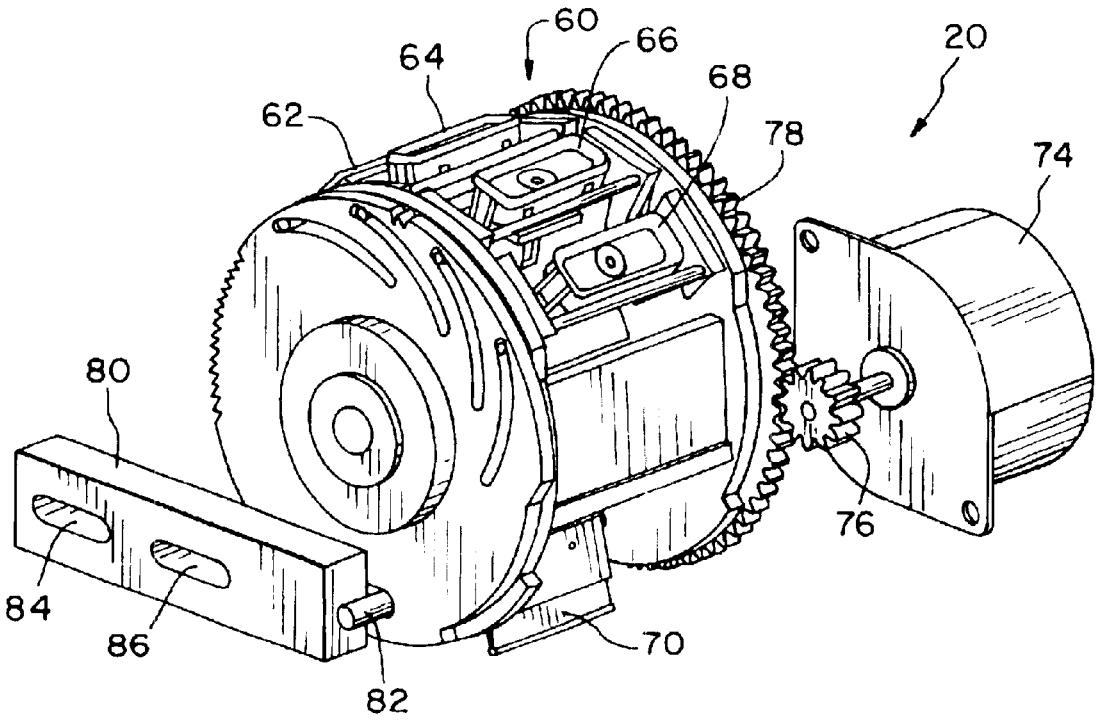
FIG. 3 is an enlarged perspective view of the maintenance station.
Figure 4:
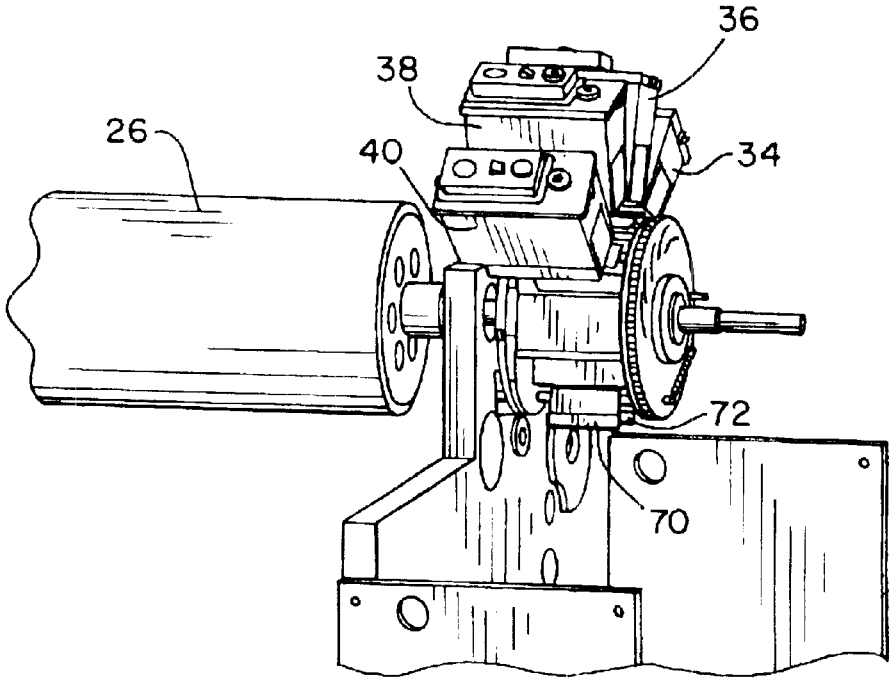
FIG. 4 is a perspective view of the maintenance station and print drum.

As can be seen most clearly in FIG. 3, maintenance station 20 includes a maintenance cylinder 60 having caps 62, 64, 66 and 68 at the periphery thereof. One cap 62, 64, 66 or 68 is provided for each of printheads 34, 36, 38 and 40. Caps 62, 64, 66 and 68 are bodies shaped to seal against nozzle plates 42, 44 and 46 of printheads 34, 36 and 38, and a nozzle plate (not shown) of printhead 40, as those skilled in the art will readily understand. Additionally, two wipers 70 and 72 (FIG. 4) are provided at the periphery of cylinder 60. Wipers 70 and 72 are compliant to a degree, to conform to the surface being wiped, and may be designed for bi-directional operation.

A stepper motor 74 is provided for rotating cylinder 60, as will be described in further detail hereinafter, and includes a drive gear 76 operatively engaged with a driven gear 78 of cylinder 60. Driven gear 78 may be formed integral with cylinder 60.

A stop block 80 is provided secured to frame 24 of printer 22, and is engaged by an actuation pin 82 of maintenance station 20 to perform camming functions of cylinder 60, as will be described in greater detail hereinafter, to effectuate the capping function of maintenance station 20. Stop block 80 includes horizontally elongated holes 84 and 86 by which stop block 80 can be secured to frame 24 with screws, bolts or the like (not shown). Stop block 80 can be adjusted horizontally so that caps 62, 64, 66 and 68 are properly aligned with printheads 34, 36, 38 and 40 during performance of the capping function.

Figure 6:
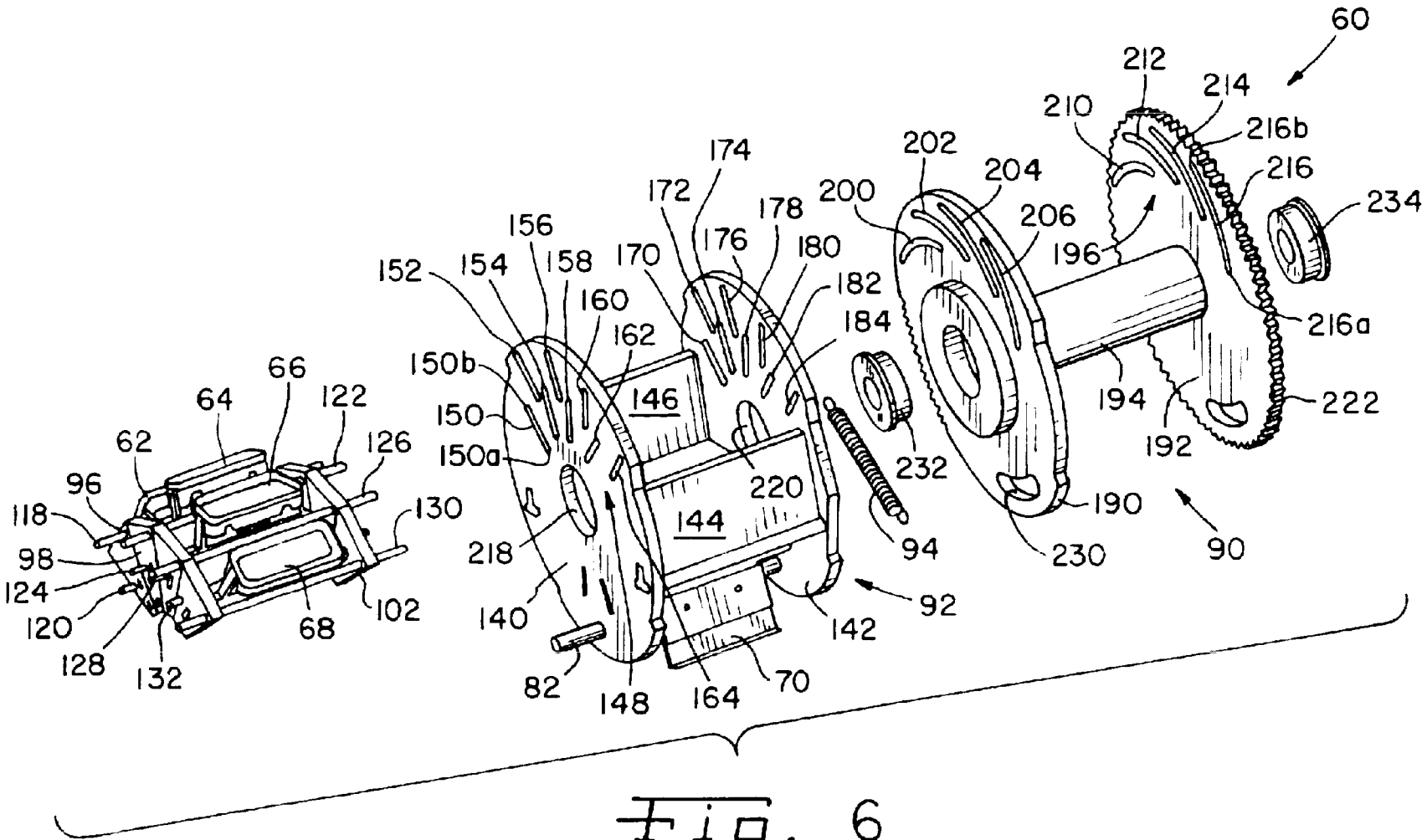
FIG. 6 is an exploded perspective view of the maintenance cylinder.

Referring now more specifically to the exploded view of FIG. 6, cylinder 60 includes a camming spool 90, a core spool 92, and a biasing spring 94. Core spool 92 is contained within camming spool 90 in the assembled form of cylinder 60, and spools 90 and 92 can rotate independently of each other. Biasing spring 94 is connected between camming spool 90 and core spool 92, to bias spools 90 and 92 to a desired positional relationship, as will be described hereinafter.

Figure 5:
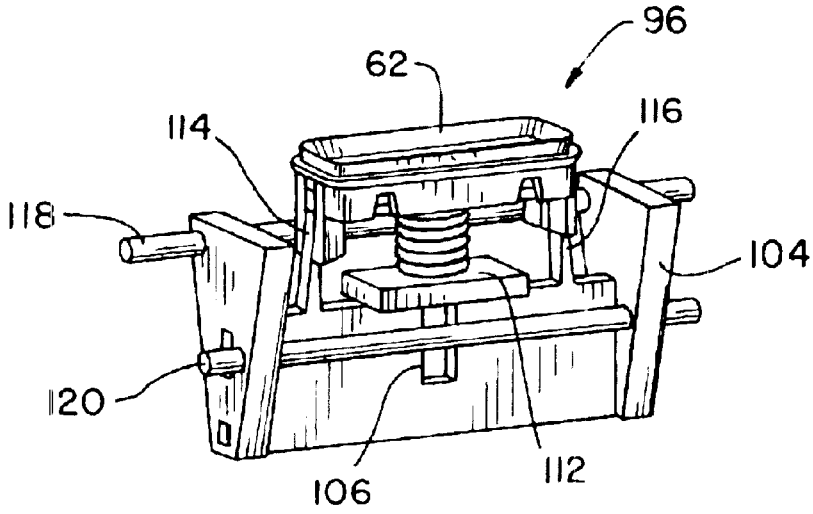
FIG. 5 is an enlarged perspective view of one capping slide of the maintenance station.
Figure 7:
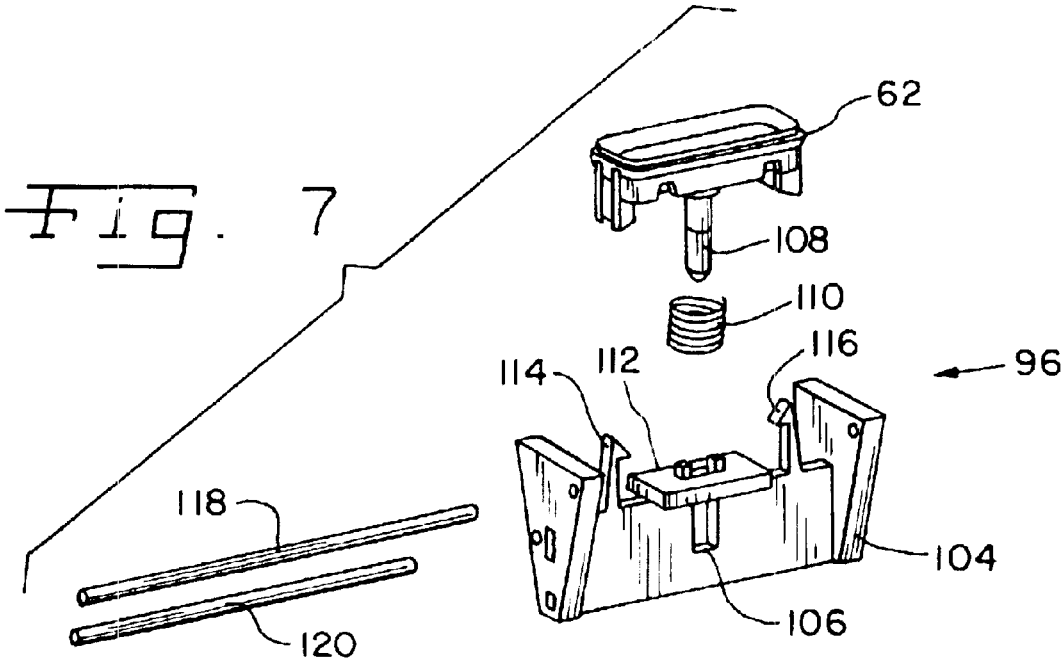
FIG. 7 is an exploded view of the capping slide shown in FIG. 5.

Four capping slides 96, 98, 100 and 102 are carried by core spool 92. Caps 62, 64, 66 and 68 are carried one each on capping slides 96, 98, 100 and 102, respectively. Each capping slide 96, 98, 100 and 102 is similar in construction. An enlarged view of capping slide 96 is shown in FIG. 5, and an exploded view of capping slide 96 is shown in FIG. 7. Capping slide 96 includes a carrier 104 having a channel 106 for receiving a post 108 from cap 62. A spring 110 is provided on post 108 between a spring seat 112 and the bottom of cap 62. Retainers 114 and 116 are provided extending upwardly at the top of carrier 104, at opposed ends of cap 62, for securing cap 62 onto carrier 104. The spring under the cap is sized to provide an appropriate amount of sealing force for engaging cap 62 against printhead 34.

Capping slide 96 further includes a long pin 118 and a short pin 120 extending therethrough, from one side thereof to the other side thereof. As shown in FIG. 6, capping slide 98 includes long pin 122 and short pin 124, capping slide 100 includes long pin 126 and short pin 128 and capping slide 102 includes long pin 130 and short pin 132. Pins 118 through 132 are mounting means by which capping slides 96, 98, 100 and 102 are secured relative to camming spool 90 and core spool 92, as will be described subsequently herein.

Core spool 92, as seen in FIG. 6, includes a core spool first end plate 140 and a core spool second end plate 142 spaced from each other by spacers 144 and 146. Wipers 70 and 72 are retained between core spool first end plate 140 and core spool second end plate 142. A core spool guide path 148 is provided for receiving long pins 118, 122, 126 and 130 and short pins 120, 124, 128 and 132 of capping slides 96, 98, 100 and 102, respectively, and for guiding radial movement thereof between a radially inner position and a radially outer position in maintenance cylinder 60. Core spool guide path 148 includes radial slots 150, 152, 154, 156, 158, 160, 162 and 164 on core spool first end plate 140, and radial slots 170, 172, 174, 176, 178, 180, 182 and 184 in core spool second end plate 142. Each radial slot 150, 152, 154, 156, 158, 160, 162 and 164 on core spool first end plate 140, and each radial slot 170, 172, 174, 176, 178, 180, 182 and 184 in core spool second end plate has a radial inward end "a" and a radial outward end "b". Only radial inward end 150a and radial outward end 150b for slot 150 have been marked in FIG. 6, for simplification and clarity purposes. Two radial slots 150 through 164 in core spool first end plate 140, and two radial slots 170 through 184 in core spool second end plate 142 are provided for each capping slide 96, 98, 100 and 102, to receive opposite ends of long pins 118, 122, 126 and 130 and short pins 120, 124, 128 and 132.

Camming spool 90 includes a camming spool first end plate 190 and a camming spool second end plate 192 separated by a sleeve 194. When assembled in printer 22 sleeve 194 receives therein an end portion of shaft 28. A camming spool guide path 196 is provided for receiving only long pins 118, 122, 126 and 130 of capping slide 96, 98, 100 and 102, respectively, which extend through core spool 92 and into camming spool 90. Camming spool guide path 196 includes spiral slots 200, 202, 204 and 206 in camming spool first end plate 190 and spiral slots 210, 212, 214 and 216 in camming spool second end plate 192. Each spiral slot 200, 202, 204, 206, 210, 212, 214 and 216 includes a radially inward end "c", and a radially outward end "d". Only radially inward end 216*c* and radially outward end 216*d* have been marked in FIG. 6 for simplification and clarity purposes.

During assembly, core spool 92 is positioned inwardly of camming spool first end plate 190 and camming spool second end plate 192, with core spool first end plate 140 immediately adjacent camming spool first end plate 190 and core spool second end plate 142 immediately adjacent camming spool second end plate 192. Core spool first end plate 140 includes a central aperture 218 by which end plate 140 is mounted on sleeve 194, and core spool second end plate 142 includes a central aperture 220 by which end plate 142 is mounted on sleeve 194. Actuation pin 82 is provided extending outwardly of core spool first end plate 140, and camming spool first end plate 190 includes an opening 230 through which actuation pin 82 extends. Bearings 232 and 234 are provided for mounting maintenance cylinder 60, and specifically camming spool first end plate 190 and camming spool second end plate 192, respectively, on shaft 28.

Thus, maintenance cylinder 60, through its mounting by bearings 232 and 234 on shaft 28, is separately and independently rotatable from the rotation of print drum 26. Drive motor 32, which rotates print drum 26, does not rotate maintenance cylinder 60, which instead is separately and independently rotated by stepper motor 74.

Camming spool second end plate 192 has an outer periphery thereof formed to function as driven gear 78, and includes a plurality of gear teeth 236. With the desired relationships of components, it is not necessary for cylinder 60 to make a complete revolution, and gear teeth 22 need not be provided completely about the periphery of cylinder 60. Instead, gear teeth 236 need be provided only on a sufficient arc to accommodate the required range of rotation of cylinder 60.

While maintenance cylinder 60 is shown and described to be mounted on shaft 28, cylinder 60 need not be mounted on the same shaft as drum 26, but, instead, can be supported on a separate shaft, so long as cylinder 60 is located at the end of print drum 26 and on the same axis as print drum 26.

Figure 8:
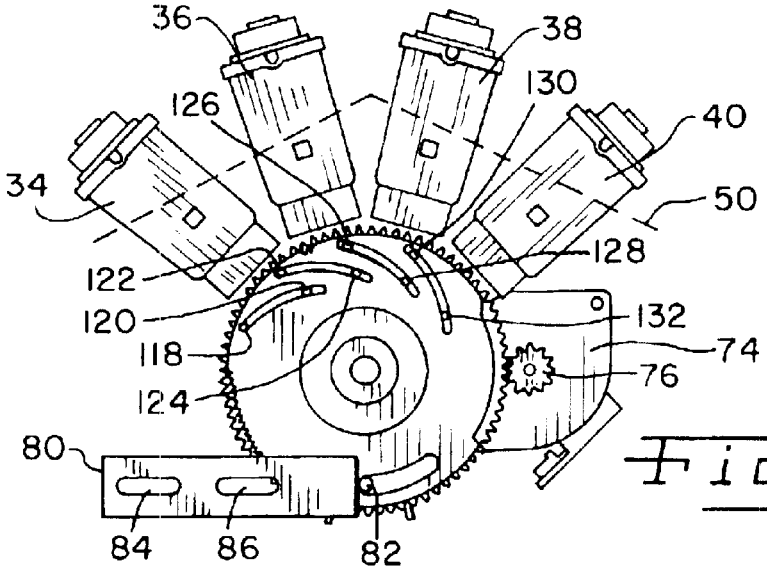
FIG. 8 is an end view of the printer, with the maintenance station in a disengaged position.

A maintenance operation for printer 22 is initiated by moving printheads 34, 36, 38 and 40 axially along print drum 26 to an axially extreme position over maintenance station 20. FIG. 8 illustrates the initial service position, with printheads 34, 36, 38 and 40 positioned above maintenance station 20, and caps 62, 64, 66 and 68 in a retracted, radially inward position. For performing capping functions, stepper motor 74 is activated to rotate cylinder 60 in a clockwise direction from the perspective of FIG. 8. Camming spool 90 and core spool 92 are rotated together until actuation pin 82 contacts stop block 80. As stepper motor 74 continues to rotate cylinder 60, core spool 92 is prevented from further rotation through the engagement of actuation pin 82 against stop block 80. However, camming spool 90, which is driven by stepper motor 74 via gear teeth 236 on camming spool second end plate 192, can continue to rotate as opening 230 is slid along then stationary actuation pin 82.

Figure 9:
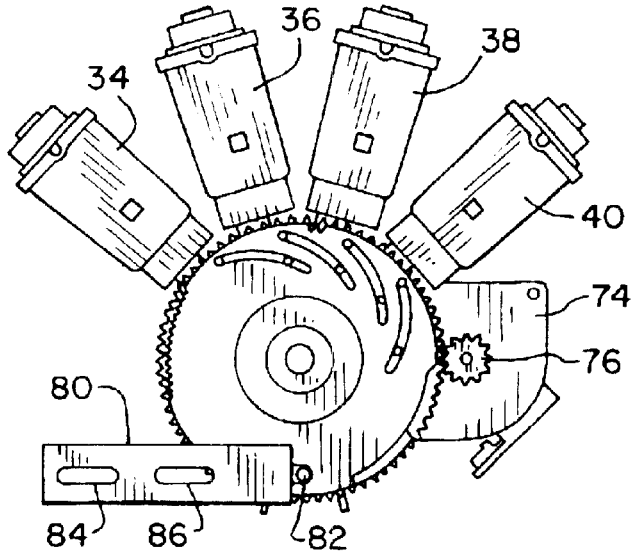
FIG. 9 is an end view of the printer, with the maintenance station in a position for capping the nozzle plates of the printheads.

With continued rotation of camming spool 90, long pins 118, 122, 126 and 130 of capping slides 96, 98, 100 and 102, move radially outward from inward ends "c" to outward ends "d" as spiral slots 200, 202, 204, 206, 210, 212, 214 and 216 are moved from the position shown in FIG. 8 to that shown in FIG. 9. Short pins 120, 124, 128 and 132 of capping slide 96, 98, 100 and 102 are caused to ascend from radially inward positions "a" to radially outward positions "b". The combined effect is a radially outward movement of each capping slide 96, 98, 100 and 102, thereby allowing caps 62, 64, 66 and 68 to engage printheads 34, 36, 38 and 40. Spring 110 on each capping slide 96, 98, 100 and 102 biases caps 62, 64, 66 and 68 with sufficient sealing force against printheads 34, 36, 38 and 40, respectively, to provide a sealed environment around nozzle plates 42, 44 and 46, and the nozzle plate not shown for printhead 40. At the radially outward, extended positions, caps 62, 64 66 and 68 are accurately spaced to sealingly engage each printhead 34, 36, 38 and 40 precisely over nozzle plates 42, 44 and 46 and the nozzle plate not shown. With caps 62, 64, 66 and 68 in place on printheads 34, 36, 38 and 40, drying of ink in the nozzles is minimized.

Figure 10:
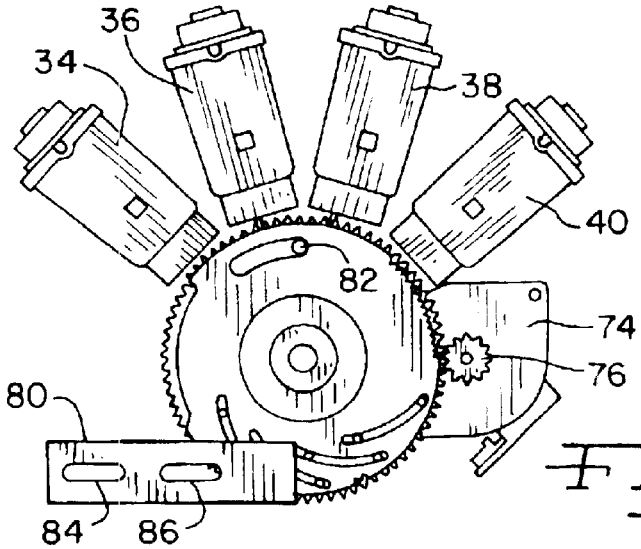
FIG. 10 is an end view of the printer, with the maintenance station in position for wiping the nozzle plates of the printheads.

When printheads 34, 36, 38 and 40 are to be uncapped to begin a new print job, stepper motor 74 is activated to rotate cylinder 60 in the opposite direction, that is, in a counterclockwise direction as shown in FIGS. 8–10. Actuation pin 82 is disengaged from stop block 80. The reverse of the camming function described above occurs, such that capping slides 96, 98, 100 and 102 are retracted as cylinder 60 is rotated from the position shown in FIG. 9 to that position shown in FIG. 8. Biasing spring 94 urges relative positioning between camming spool 90 and core spool 92, such as to retain capping slides 96, 98, 100 and 102 in retracted or radially inward positions relative to the periphery cylinder 60.

As depicted in the drawings, wiper blades 70 and 72 are positioned in cylinder 60 approximately 180° from the position of the assembly consisting of capping slides 96, 98, 100 and 102. However, the relative positions therefor are arbitrary. Further, while two wipers 70 and 72 are shown, the wiping function to be described subsequently can be performed with a single wiper 70 or 72, or with more than two wipers 70 and 72.

During a wiping function, stepper motor 74 is activated to rotate cylinder 60 to bring wipers 70 and 72 into engagement with printheads 34, 36, 38 and 40. As shown in the drawings, cylinder 60 is rotated counterclockwise from the position shown in FIGS. 8 or 9 to that shown in FIG. 10. Stepper motor 74 is then caused to rotate in alternate directions, to cause wipers 70 and 72 to wipe back and forth across each printhead 34, 36, 38 and 40, and specifically to wipe nozzle plates 42, 44, 46 shown, and the one nozzle plate not shown. As many passes as necessary can be made for wipers 70 and 72 across printheads 34, 36, 38 and 40, to effectuate appropriate wiping. Wipers 70 and 72 can be so arranged that the rotation of cylinder 60 in alternate directions causes wiper 70 to wipe printheads 34 and 36, and wiper 72 to wipe printheads 38 and 40. Alternatively, each wiper 70 and 72 can be caused to wipe all printheads 34, 36, 38 and 40. Since cylinder 60 is axially aligned with drum 26, and thereby also aligned with the axis of the arc along which printheads 34, 36, 38 and 40 are disposed, wipers 70 and 72 will sweep across each printhead 34, 36, 38 and 40 as cylinder 60 is rotated.

As those skilled in the art will readily understand, the wiping function performed by wipers 70 and 72 may be effectuated immediately prior to a capping function described previously.

When printer 22 is active, and maintenance station 20 is in the parked or inoperative position, cylinder 60 is rotated such that capping slides 96, 98, 100 and 102 are retracted from the periphery of cylinder 60, and wipers 70 and 72 are disposed in an out of the way position. Thus, maintenance station 20 can be retained in a non-obstructing position relative to movement of carriage 50 and printheads 34, 36, 38 and 40 during printing operations. The location of cylinder 60 axially outwardly from print drum 26 prevents the interference of maintenance station 20 with normal printing operations, including the movement of carriage 50 axially along drum 26.

While rotation of cylinder 60 has been shown to be achieved through the use of stepper motor 74, it should be understood that cylinder 60 could also be driven by a DC motor or controlled by the carrier positioning. Rotational drive of cylinder 60 is not intended to be limited to the use of a stepper motor 74.

The present invention provides a simple maintenance station that performs capping and wiping operations for radially mounted ink jet printheads. The maintenance station is simple to actuate, and does not interfere with carriage movement or printing operations.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer comprising:

a printer frame;

a print drum supported by said frame;

a plurality of printheads arranged radially of said drum;

a printhead maintenance station disposed at an end of said print drum, said station including;

a rotatable maintenance cylinder having a periphery;

a plurality of caps located at the periphery of said maintenance cylinder; and means for rotating said cylinder and moving said caps radially in said maintenance cylinder between a radially inward position and a radially outward position; and carriage means moving said plurality of said printheads along said print drum and over said maintenance cylinder.

2. The printer of claim 1, including a wiper at the periphery of said maintenance cylinder.

3. The printer of claim 2, including four printheads, four caps and two wipers.

4. The printer of claim 1, said maintenance cylinder including a core spool and a camming spool, and said means for moving said caps including pins mounting said caps to said core spool and said camming spool and means for causing relative rotational movement between said core spool and said camming spool.

5. The printer of claim 4, including a carrier for each said cap, and first and second pins for each said carrier connecting each said carrier to said core spool, one of said first and second pins for each said carrier connecting each said carrier to said camming spool.

6. The printer of claim 5, including four printheads, four caps and two wipers, each said cap carried on a separate said carrier, each of said two wipers at the periphery of said maintenance cylinder.

7. The printer of claim 5, said core spool including a plurality of radial slots, said first and second pins being disposed one each in said radial slots; said camming spool including a plurality of spiral slots, said one of said first and second pins for each said carrier extending through a radial slot and into a spiral slot.

8. The printer of claim 7, including a stop block adjacent said maintenance cylinder, and an actuation pin secured to said core spool, said actuation pin adapted and arranged to engage said stop block upon rotation of said maintenance cylinder.

9. The printer of claim 8, including a stepper motor in driving engagement with said camming spool.

10. The printer of claim 8, said stop block being adjustably secured to said printer frame.

11. The printer of claim 1, said maintenance cylinder in axial alignment with said drum.

12. The printer of claim 11, including a shaft supported by said frame, said print drum and said maintenance cylinder disposed on said shaft.

13. The printer of claim 12, including bearings between said maintenance cylinder and said shaft, and said maintenance cylinder being rotatable independently from rotation of said shaft.

14. The printer of claim 13, including a stepper motor drivingly engaged to said maintenance cylinder.

15. The printer of claim 14, including a plurality of gear teeth defined by said maintenance cylinder, and said stepper motor being drivingly engaged with said gear teeth.

16. A maintenance station for an ink jet printer comprising:

a camming spool having first and second camming spool end plates;

a core spool having first and second core spool end plates;

a capping slide having a carrier, a nozzle plate cap carried on said carrier and mounting means suspending said carrier between said first and second core spool end plates and between said first and second camming spool end plates;

said camming spool defining a camming spool guide path for said mounting means between a radially inner position and a radially outer position;

said core spool defining a core spool guide path for said mounting means between a radially inner position and a radially outer position; and a drive system for rotating said core spool and said camming spool both jointly with and independently of each other.

17. The maintenance station of claim 16, said core spool guide path including radial slots in said first and second core spool end plates and said camming spool guide path including spiral slots in said first and second camming spool end plates.

18. The maintenance station of claim 17, said mounting means including a first pin attached to said carrier and restrained in said core spool radial slots only, and a second pin attached to said carrier and restrained in each said core spool radial slots and said camming spool spiral slots.

19. The maintenance station of claim 18, including a nozzle plate wiper disposed between said core spool first and second end plates.

20. The maintenance station of claim 18, said core spool first and second end plates disposed between said camming spool first and second end plates.

21. The maintenance station of claim 18, including a stop for constraining rotation of said core spool independent of rotation of said camming spool.

22. The maintenance station of claim 21, including an actuation pin attached to said core spool, and a stop block engaged by said actuation pin to stop rotation of said core spool.

23. The maintenance station of claim 22, including a stepper motor, and one of said camming spool first and second end plates having gear teeth on the periphery thereof, said stepper motor being drivingly engaged with said gear teeth.

24. The maintenance station of claim 23, including a nozzle plate wiper disposed between said core spool first and second end plates.

25. The maintenance station of claim 23, said core spool first and second ends disposed between said camming spool first and second ends.

26. The maintenance station of claim 16, including a nozzle plate wiper disposed between said core spool first and second end plates.

27. The maintenance station of claim 16, said core spool first and second ends disposed between said camming spool first and second ends.

28. The maintenance station of claim 16, including a stop for constraining rotation of said core spool independent of said camming spool.

29. The maintenance station of claim 16, including a plurality of capping slides, each having a carrier, a nozzle plate cap carried on said carrier and mounting means suspended, each said carrier between said first and second core spool end plates and between said first and second camming spool end plates.

30. The maintenance station of claim 16, including a biasing spring engaged between said core spool and said camming spool, urging a position between said core spool and said camming spool with said capping slide in the radially inner position.

31. A method for servicing a plurality of printheads arranged on an arc radially outwardly of a print drum, said method comprising steps of:

providing a maintenance station at an end of the drum, the maintenance station including a rotatable cylinder and a plurality of radially arranged retractable caps, a separate one of the caps for each the printheads;

moving the printheads axially outward of the drum and in alignment with the maintenance station;

rotating the cylinder to position a cap beneath each printhead; and elevating the caps into sealing relationship with the printheads.

32. The method of claim 31, said rotating the cylinder performing said step of elevating the caps against the printheads.

33. The method of claim 32, including providing a wiper at the periphery of the cylinder and wiping the printheads by rotating the cylinder.

34. The method of claim 31, including providing a core spool and a camming spool in the cylinder, and rotating the camming spool independently of the core spool for said step of elevating the caps.

35. The method of claim 34, including providing a wiper at the periphery of the cylinder and wiping the printheads by rotating the cylinder.

36. The method of claim 34, including providing a stop block and an actuation pin connected to the core spool, rotating the core spool and the camming spool to bring the actuation pin into engagement with the stop block, and continuing rotating the camming spool independently of the core spool for said step of elevating the caps.

* * * * *